US011396079B2

(12) United States Patent
Chen et al.

(10) Patent No.: US 11,396,079 B2
(45) Date of Patent: Jul. 26, 2022

(54) AUTOMATIC GRINDING DEVICE FOR WELD BEADING ON INNER WALL OF PIPELINE WITH LARGE LENGTH TO DIAMETER RATIO

(71) Applicant: Nanchang Hangkong University, Nanchang (CN)

(72) Inventors: Yuhua Chen, Nanchang (CN); Timing Zhang, Nanchang (CN); Yongde Huang, Nanchang (CN); Shanlin Wang, Nanchang (CN); Jinyang Hu, Nanchang (CN); Lei Zhang, Nanchang (CN); Xiangyi Wang, Nanchang (CN); Jin Jiang, Nanchang (CN)

(73) Assignee: Nanchang Hangkong University, Nanchang (CN)

( * ) Notice: Subject to any disclaimer, the term of this patent is extended or adjusted under 35 U.S.C. 154(b) by 479 days.

(21) Appl. No.: 16/715,248

(22) Filed: Dec. 16, 2019

(65) Prior Publication Data

US 2020/0198087 A1 Jun. 25, 2020

(30) Foreign Application Priority Data

Dec. 24, 2018 (CN) ..... 201811581162.3

(51) Int. Cl.
*B24B 29/08* (2006.01)

(52) U.S. Cl.
CPC ..... *B24B 29/08* (2013.01)

(58) Field of Classification Search
CPC ..... B24B 29/08; B24B 29/06; B24B 27/0084
USPC ..... 30/103, 108
See application file for complete search history.

(56) References Cited

U.S. PATENT DOCUMENTS 4,220,201 A * 9/1980 Hauk ..... E21B 29/00 83/191
4,903,406 A * 2/1990 Schosek ..... B23D 21/02 30/103
4,980,996 A * 1/1991 Klink ..... B24B 29/08 29/888.06
7,434,315 B2 * 10/2008 Tjader ..... B23D 21/02 30/103

* cited by examiner

*Primary Examiner* — Omar Flores Sanchez
(74) *Attorney, Agent, or Firm* — ArentFox Schiff LLP; Michael Fainberg

(57) ABSTRACT

The present invention discloses an automatic grinding device for weld beading on the inner wall of a pipeline with a large length to diameter ratio. The automatic grinding device includes a supporting module, and a walking module, a working module and a control module which are arranged on the supporting module, where the walking module is used for moving the supporting module to the butt welding position of the pipeline; the working module is used for grinding the weld beading; and the control module is used for controlling the actions of the walking module and the working module. When the pipeline rotates along the axial direction, the position of the grinding device can remain at the bottom of the pipeline, rather than rotating together with the pipeline, and the elimination of weld beading on the whole circumference at the butt welding position of the pipeline is realized.

8 Claims, 3 Drawing Sheets

AUTOMATIC GRINDING DEVICE FOR WELD BEADING ON INNER WALL OF PIPELINE WITH LARGE LENGTH TO DIAMETER RATIO

CROSS-REFERENCE TO RELATED APPLICATIONS

This application claims priority to Chinese Patent Application No. 201811581162.3 filed on Dec. 24, 2018, the entire contents of which is hereby incorporated by reference.

TECHNICAL FIELD

The present invention relates to the technical field of weld beading treatment, in particular to an automatic grinding device for weld beading on the inner wall of a pipeline with a large length to diameter ratio.

BACKGROUND

Weld beading looks like tiny pimples formed by metal flowing under gravity when liquid metal is solidified due to the fact that metal welding spots are locally melted at high temperature through current in the welding process of metal. After the welding of pipe components is completed, the weld beading can remain inside and outside circular pipes. External weld beading can be grinded and removed through a grinding machine, but internal weld beading is extremely difficult to treat, particularly in butt welding of circular pipes with a large length to diameter ratio.

The patent application with the publication number of CN106583851A discloses a cutting device for weld beading inside welded junctions of a pipeline, the cutting device includes a tubular support device, an annular cutting knife group and a supporting adjusting component, and the annular cutting knife group is connected with the tubular support device through the supporting adjusting component. The cutting device passes through a pipeline to be treated from left to right by pulling a traction tool, so that the weld beading can be cleaned. However, the cutting device is relatively low in adaptability for pipes with different diameters, when there is much weld beading at the welded junctions of the pipeline, the requirement on traction force is relatively high, and the smoothness of outline after the weld beading is cut cannot be guaranteed.

Therefore, the problem urgently to be solved by the persons skilled in the art is how to provide an automatic grinding device for weld beading on the inner wall of a pipeline with a large length to diameter ratio, which is used for improving the removal effect of the weld beading and improving the adaptability of pipes with different diameters.

SUMMARY

The present invention aims to provide an automatic grinding device for weld beading on the inner wall of a pipeline with a large length to diameter ratio, which is used for improving the removal effect of the weld beading and the adaptability on pipes with different diameters.

To achieve the above purpose, the present invention provides the following technical solutions.

The present invention provides an automatic grinding device for weld beading on the inner wall of a pipeline with a large length to diameter ratio, including a supporting module, a walking module, a working module and a control module, where the supporting module includes a support frame, omni-directional wheel supports, height adjusting frames, a supporting plate and springs, the upper ends of the omni-directional wheel supports are fixed to the lower side of the support frame, the supporting plate is arranged above the support frame, the supporting plate is connected with the support frame through the height adjusting frames, and the springs are arranged on the upper surface of the supporting plate;

the walking module includes universal wheels, omni-directional wheels and omni-directional wheel motors, the universal wheels are fixed to the upper ends of the springs, the omni-directional wheels are rotatably connected to the lower ends of the omni-directional wheel supports, and the omni-directional wheel motors are used for driving the omni-directional wheels to rotate;

the working module includes a grinding machine and a grinding angle control motor, one end of the grinding machine is rotatably connected with the support frame, and the grinding angle control motor is used for controlling the angle of the grinding machine;

the control module includes a camera and a controller, the output end of the camera is electrically connected with the input end of the controller, and the output end of the controller is electrically connected with the omni-directional wheel motors and the grinding angle control motor.

Preferably, the support frame includes a left support, a right support and a plurality of connecting rods, the left support and the right support are connected through the connecting rods; the connecting rods include upper connecting rods for being connected with the height adjusting frames and lower connecting rods for being connected with the omni-directional wheel supports, and the connecting rods are symmetrically distributed on the front and rear sides of the support frame.

Preferably, multiple groups of height adjusting frames are symmetrically distributed on the front and rear sides of the support frame, each height adjusting frame includes a first supporting rod and a second supporting rod, one end of each first supporting rod is rotatably connected with one end of the corresponding second supporting rod through a locking piece, each locking piece can lock an included angle between the corresponding first supporting rod and the corresponding second supporting rod, the other ends of the first supporting rods are rotatably connected with the supporting plate, and the other ends of the second supporting rods are rotatably connected with the connecting rods.

Preferably, the camera and the controller are arranged on the left support, and the grinding machine and the grinding angle control motor are arranged on the right support.

Preferably, the automatic grinding device for weld beading on the inner wall of the pipeline with a large length to diameter ratio further includes a counterweight module, where the counterweight module is arranged on the right support.

Preferably, the automatic grinding device for weld beading on the inner wall of the pipeline with a large length to diameter ratio further includes a clamping structure, where the clamping structure is a rotary clamp, and the clamping structure is used for clamping one end of the pipeline after butt welding and can enable the pipeline after butt welding to rotate by using the horizontal direction as the axis.

Preferably, the clamping structure includes a support plate, a first transition disc, a bearing, a second transition disc and a chuck, the chuck is used for clamping one end of the pipeline, the chuck is connected with the bearing through the second transition disc, and the bearing is connected with the support plate through the first transition disc.

Preferably, there are two universal wheels and two springs which are respectively distributed along the longitudinal direction of the supporting plate, and there are four omni-directional wheels which are symmetrically distributed on the front and rear sides of the support frame in the longitudinal direction.

Compared with the prior art, the present invention achieves the following technical effects:

through the arrangement of omni-directional wheels and universal wheels, when the grinding device walks along the left-right direction, the grinding device still can slide laterally; and therefore, when the pipeline rotates along the axial direction, the position of the grinding device can remain at the bottom of the pipeline, rather than rotating together with the pipeline;

through the arrangement of height adjusting frames and springs, pre-compression is carried out on the springs so as to guarantee that the universal wheels are always laminated to the inner wall of the pipeline in the walking process of the grinding device, and the height adjusting frames are adjusted so as to flexibly adapt pipelines with different inner diameters.

Through the arrangement of a camera, the grinding effect inside a circular pipe can be monitored in real time.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

Description of attached drawing marks: 1, first circular pipe; 2, second circular pipe; 3, weld beading; 4, support plate; 5, first transition disc; 6, bearing; 7, second transition disc; 8, chuck; 9, grinding component; 10, camera; 11, support frame; 12, controller; 13, spring; 14, universal wheel; 15, counterweight module; 16, grinding angle control motor; 17, grinding machine; 18, omni-directional wheel; 19, connecting rod; 20, omni-directional wheel motor; 21, omni-directional wheel support; 22, second supporting rod; 23, first supporting rod; and 24, supporting plate.

DETAILED DESCRIPTION

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

The present invention aims to provide an automatic grinding device for weld beading on the inner wall of a pipeline with a large length to diameter ratio, which is used for improving the removal effect of the weld beading and the adaptability on pipes with different diameters.

To make the foregoing objective, features, and advantages of the present invention clearer and more comprehensible, the present invention is further described in detail below with reference to the accompanying drawings and specific embodiments.

Figure 1:
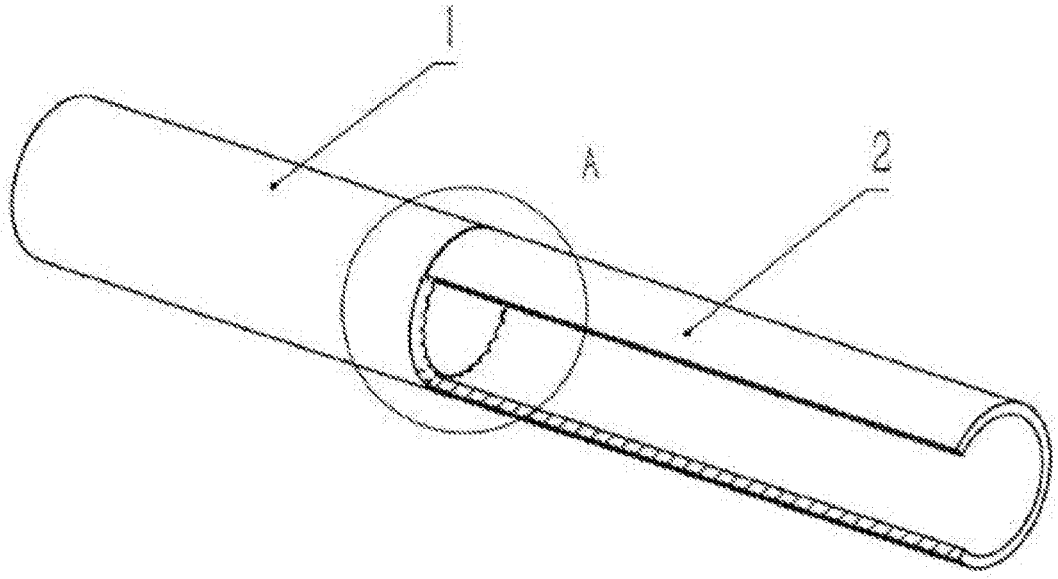
FIG. 1 is a welding schematic diagram of a circular pipe with a large length to diameter ratio.
Figure 2:
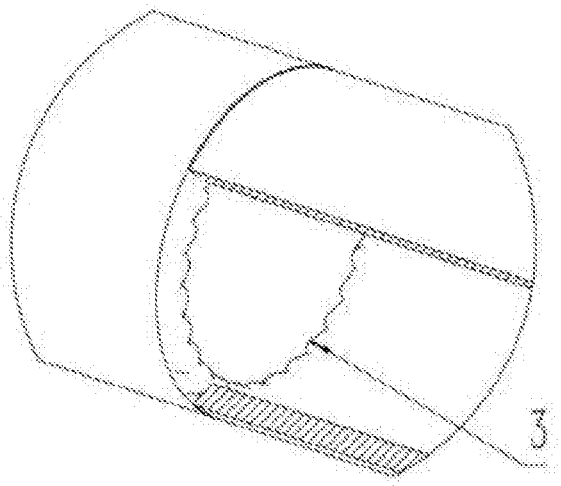
FIG. 2 is an amplified schematic diagram of a weld beading part.
Figure 3:
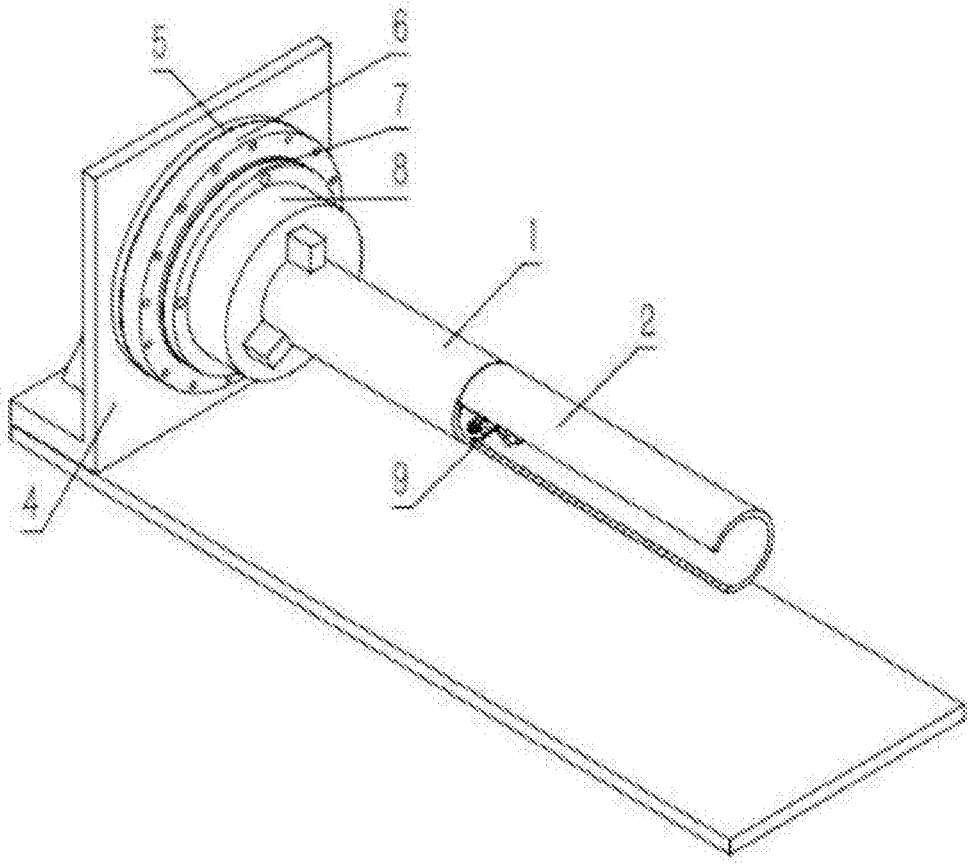
FIG. 3 is a clamping schematic diagram of the pipeline after butt welding.
Figure 4:
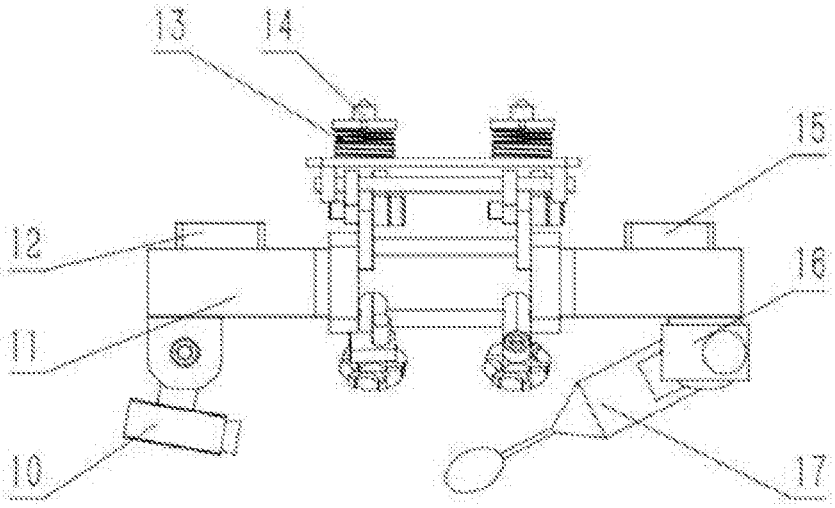
FIG. 4 is a front view of a grinding component.
Figure 5:
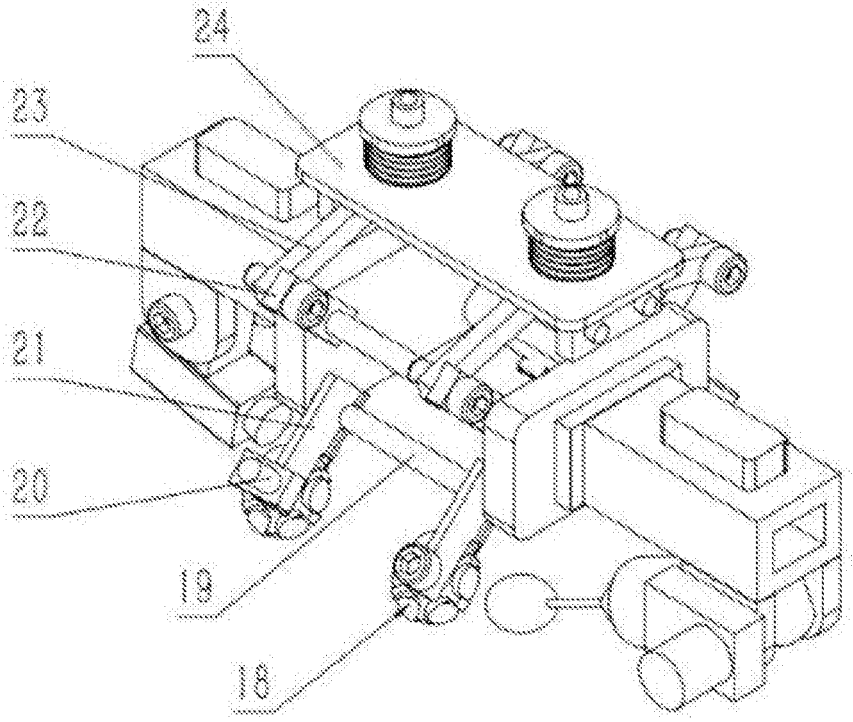
FIG. 5 is an axis side view of the grinding component.

As shown in FIG. 1 to FIG. 5, the automatic grinding device for weld beading on the inner wall of the pipeline with a large length to diameter ratio provided by the embodiment includes a grinding component 9, and the grinding component 9 includes a supporting module, and a walking module, a working module and a control module which are arranged on the supporting module, where the walking module is used for moving the supporting module to the butt welding positions of a first circular pipe 1 and a second circular pipe 2, the working module is used for grinding the weld beading 3, and the control module is used for controlling the actions of the walking module and the working module.

The supporting module includes a support frame 11, omni-directional wheel supports 21, height adjusting frames, a supporting plate 24 and springs 13. The upper ends of the omni-directional wheel supports 21 are fixed to the lower side of the support frame 11, and the omni-directional wheel supports 21 are used for installing omni-directional wheels 18, so that the support frame 11 is supported. The supporting plate 24 is arranged above the support frame 11, the supporting plate 24 is connected with the support frame 11 through the height adjusting frames, and the springs 13 are arranged on the upper surface of the supporting plate 24. The springs 13 are used for installing universal wheels 14, and pre-compression is carried out on the springs 13 so as to guarantee that the universal wheels 14 are always laminated to the inner wall of the pipeline in the walking process of the grinding device. The height adjusting frames are used for adjusting the relative distance between the supporting plate 24 and the support frame 11, so that pipelines with different inner diameters are adapted flexibly.

The walking module includes universal wheels 14, omni-directional wheels 18 and omni-directional wheel motors 20, the universal wheels 14 are fixed to the upper ends of the springs, the omni-directional wheels 18 are rotatably connected to the lower ends of the omni-directional wheel supports 21, the omni-directional wheel motors 20 are fixed to the lower ends of the omni-directional wheel supports 21, and the omni-directional wheel motors 20 are used for driving the omni-directional wheels 18 to rotate. In the embodiment, there are two universal wheels 14 and two springs 13 which are respectively distributed along the longitudinal direction of the supporting plate 24, and there are four omni-directional wheels 18 which are symmetrically distributed on the front and rear sides of the support frame 11 in the longitudinal direction. Due to the own structural characteristics of the omni-directional wheels 18, when the grinding component 9 walks along the left-right direction, the grinding component still can slide laterally, and therefore, when the pipeline rotates along the axial direction, the position of the grinding component 9 can remain at the bottom of the pipeline.

The working module includes a grinding machine 17 and a grinding angle control motor 16, and one end of the grinding machine 17 is rotatably connected with the support frame 11. The grinding angle control motor 16 is fixed onto the support frame 11, and is used for controlling the angle of the grinding machine 17. In the embodiment, the rotating axis of the grinding machine 17 is the front-and-rear direction, so that a grinding head of the grinding machine 17 can swing in a vertical plane vertical to the front-and-rear direction.

The control module includes a camera 10 and a controller 12, the output end of the camera 10 is electrically connected with the input end of the controller 12, and the output end of the controller 12 is electrically connected with the omni-directional wheel motors 20 and the grinding angle control motor 16. The control mode that the walking module is controlled by the control module according to image information obtained by the camera 10 is a mature technology in the field, rather than an innovation point of the embodiment, and thus the control mode is not explained here.

Further, in order to facilitate manufacturing, assembling and disassembling, simultaneously, for the purposes of saving materials and reducing overall weight, the support frame 11 in the embodiment includes a left support, a right support and connecting rods 19, and the left support and the right support are connected through the connecting rods 19. There are four connecting rods 19, the connecting rods 19 include two upper connecting rods for being connected with the height adjusting frames and two lower connecting rods for being connected with the omni-directional wheel supports 21, and the connecting rods 19 are symmetrically distributed on the front and rear sides of the support frame 11.

The height adjusting frames are common structures in the prior art, and are in various forms. In the embodiment, there are four groups of height adjusting frames which are symmetrically distributed on the front and rear sides of the support frame 11. Each height adjusting frame includes a first supporting rod 23 and a second supporting rod 22, one end of each first supporting rod 23 is rotatably connected with one end of the corresponding second supporting rod 22 through a locking piece, each locking piece can lock an included angle between the corresponding first supporting rod 23 and the corresponding second supporting rod 22. The other ends of the first supporting rods 23 are rotatably connected with the supporting plate 24, and the other ends of the second supporting rods 22 are rotatably connected with the connecting rods 19. When in use, the locking pieces firstly need to be unscrewed, and after the position of the supporting plate 24 is determined, the relative angles of the first supporting rods 23 and the second supporting rods 22 can be fixed through the locking pieces, so that the relative position relationship between the supporting plate 24 and the support frame 11 can be locked.

To well balance the distribution of the overall weight and avoid interference between the action of the camera 10 and the action of the grinding machine 17, in the embodiment, the camera 10 and the controller 12 are arranged on the left support, and the grinding machine 17 and the grinding angle control motor 16 are arranged on the right support.

In order to improve the inertia of the grinding device, the original position can keep more stably when the pipeline rotates, a counterweight module 15 is further arranged in the embodiment, and the counterweight module 15 is preferably arranged on the right support so as to alleviate the vibration of the right support when the grinding machine 17 operates.

It should be noted that pipelines need to rotate during grinding in order to grind the whole circumferences of the first circular pipe 1 and the second circular pipe 2 at the position of butt welding. The pipeline rotates in various forms, besides the grinding component 9, a clamping structure is further arranged in the embodiment, and the rotation of the pipeline is realized by setting the clamping structure. The clamping structure is a rotary clamp, and the clamping structure is used for clamping one end of the pipeline after butt welding and can enable the pipeline after butt welding to rotate by using the horizontal direction as the axis.

Specifically, the clamping structure includes a support plate 4, a first transition disc 5, a bearing 6, a second transition disc 7 and a chuck 8, the chuck 8 is used for clamping one end of the first circular pipe 1, the chuck 8 is connected with the bearing 6 through the second transition disc 7, and the bearing 6 is connected with the support plate 4 through the first transition disc 5. After the grinding machine 17 is started and starts to grind, the chuck 8 rotates, and the grinding component 9 does not rotate together with the chuck 8, so that the weld beading 3 can be grinded and eliminated gradually.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the invention.

What is claimed is:

1. An automatic grinding device for weld beading on the inner wall of a pipeline with a large length to diameter ratio, comprising a supporting module, a walking module, a working module and a control module, wherein the supporting module comprises a support frame, omni-directional wheel supports, height adjusting frames, a supporting plate and springs, the upper ends of the omni-directional wheel supports are fixed to the lower side of the support frame, the supporting plate is arranged above the support frame, the supporting plate is connected with the support frame through the height adjusting frames, and the springs are arranged on the upper surface of the supporting plate;

the walking module comprises universal wheels, omni-directional wheels and omni-directional wheel motors, the universal wheels are fixed to the upper ends of the springs, the omni-directional wheels are rotatably connected to the lower ends of the omni-directional wheel supports, and the omni-directional wheel motors are used for driving the omni-directional wheels to rotate;

the working module comprises a grinding machine and a grinding angle control motor, one end of the grinding machine is rotatably connected with the support frame, and the grinding angle control motor is used for controlling the angle of the grinding machine;

the control module comprises a camera and a controller, the output end of the camera is electrically connected with the input end of the controller, and the output end of the controller is electrically connected with the omni-directional wheel motors and the grinding angle control motor.

2. The automatic grinding device for weld beading on the inner wall of the pipeline with a large length to diameter ratio according to claim 1, wherein the support frame comprises a left support, a right support and a plurality of connecting rods, the left support and the right support are connected through the connecting rods; the connecting rods comprise upper connecting rods for being connected with the height adjusting frames and lower connecting rods for being connected with the omni-directional wheel supports, and the connecting rods are symmetrically distributed on the front and rear sides of the support frame.

3. The automatic grinding device for weld beading on the inner wall of the pipeline with a large length to diameter ratio according to claim 2, wherein multiple groups of height adjusting frames are symmetrically distributed on the front and rear sides of the support frame, each height adjusting frame comprises a first supporting rod and a second supporting rod, one end of each first supporting rod is rotatably connected with one end of the corresponding second supporting rod through a locking piece, each locking piece can lock an included angle between the corresponding first supporting rod and the corresponding second supporting rod, the other ends of the first supporting rods are rotatably connected with the supporting plate, and the other ends of the second supporting rods are rotatably connected with the connecting rods.

4. The automatic grinding device for weld beading on the inner wall of the pipeline with a large length to diameter ratio according to claim 3, wherein the camera and the controller are arranged on the left support, and the grinding machine and the grinding angle control motor are arranged on the right support.

5. The automatic grinding device for weld beading on the inner wall of the pipeline with a large length to diameter ratio according to claim 4, further comprising a counterweight module, wherein the counterweight module is arranged on the right support.

6. The automatic grinding device for weld beading on the inner wall of the pipeline with a large length to diameter ratio according to claim 1, further comprising a clamping structure, wherein the clamping structure is a rotary clamp, and the clamping structure is used for clamping one end of the pipeline after butt welding and can enable the pipeline after butt welding to rotate by using the horizontal direction as the axis.

7. The automatic grinding device for weld beading on the inner wall of the pipeline with a large length to diameter ratio according to claim 6, wherein the clamping structure comprises a support plate, a first transition disc, a bearing, a second transition disc and a chuck, the chuck is used for clamping one end of the pipeline, the chuck is connected with the bearing through the second transition disc, and the bearing is connected with the support plate through the first transition disc.

8. The automatic grinding device for weld beading on the inner wall of the pipeline with a large length to diameter ratio according to claim 1, wherein there are two universal wheels and two springs which are respectively distributed along the longitudinal direction of the supporting plate, and there are four omni-directional wheels which are symmetrically distributed on the front and rear sides of the support frame in the longitudinal direction.

* * * * *